US011753695B2

(12) United States Patent
Huang et al.

(10) Patent No.: US 11,753,695 B2
(45) Date of Patent: Sep. 12, 2023

(54) DEVICE AND METHOD FOR CONTINUOUS TEMPERATURE GRADIENT HEAT TREATMENT OF ROD-SHAPED MATERIAL

(71) Applicant: Northwestern Polytechnical University, Xi'an (CN)

(72) Inventors: Taiwen Huang, Xi'an (CN); Lin Liu, Xi'an (CN); Min Guo, Xi'an (CN); Haijun Su, Xi'an (CN); Jun Zhang, Xi'an (CN); Wenchao Yang, Xi'an (CN); Zheliang Liu, Xi'an (CN); Yinuo Guo, Xi'an (CN); Huating Chang, Xi'an (CN); Hui Shen, Xi'an (CN); Shaoying Li, Xi'an (CN)

(73) Assignee: Northwestern Polytechnical University, Shaanxi Province (CN)

( * ) Notice: Subject to any disclaimer, the term of this patent is extended or adjusted under 35 U.S.C. 154(b) by 179 days.

(21) Appl. No.: 17/360,409

(22) Filed: Jun. 28, 2021

(65) Prior Publication Data

US 2021/0404033 A1 Dec. 30, 2021

(30) Foreign Application Priority Data

Jun. 28, 2020 (CN) ..... 202010596353.8

(51) Int. Cl.

| | |
|---|---|
| ***C21D 11/00*** | (2006.01) |
| ***C21D 1/773*** | (2006.01) |
| ***C21D 9/00*** | (2006.01) |
| ***C21D 9/52*** | (2006.01) |

(52) U.S. Cl.

CPC ..... *C21D 11/00* (2013.01); *C21D 1/773* (2013.01); *C21D 9/0075* (2013.01); *C21D 9/525* (2013.01)

(58) Field of Classification Search

None

See application file for complete search history.

(56) References Cited

FOREIGN PATENT DOCUMENTS

| | | | |
|---|---|---|---|
| CN | 203356572 U | | 12/2013 |
| CN | 102112086 B | | 5/2014 |
| CN | 104451090 A | * | 3/2015 |
| CN | 104451090 A | | 3/2015 |

OTHER PUBLICATIONS

Machine Translation of CN-104451090-A (Year: 2015).*

* cited by examiner

*Primary Examiner* — Kevin E Yoon
*Assistant Examiner* — Ryan L Heckman
(74) *Attorney, Agent, or Firm* — James F. Lea, III; Gable Gotwals

(57) ABSTRACT

A device and a method for continuous temperature gradient heat treatment of a rod-shaped material are disclosed. The furnace body of the device includes an upper heating zone and a lower heating zone inside, which are independently controlled in temperature by means of an upper heating power supply and a lower heating power supply. Moreover, both the upper heating zone and the lower heating zone are closed heating zones. The closed heat insulation plates could prevent heat loss and ensure precise temperature control of the upper heating zone and the lower heating zone. In the device, a vacuum pumping equipment is included; an annular radiation screen is configured between the upper heating zone and the lower heating zone, and the rod-shaped material is not in contact with the annular radiation screen The rod-shaped material conducts one-dimensional heat transfer along the axial direction.

6 Claims, 3 Drawing Sheets

DEVICE AND METHOD FOR CONTINUOUS TEMPERATURE GRADIENT HEAT TREATMENT OF ROD-SHAPED MATERIAL

CROSS REFERENCE TO RELATED APPLICATIONS

This patent application claims the benefit and priority of Chinese Patent Application No. 2020105963518 filed on Jun. 28, 2020, the disclosure of which is incorporated by reference herein in its entirety as part of the present application.

FIELD OF THE INVENTION

The present disclosure relates to the technical field of heat treatment, and more specifically, to a device and a method for continuous temperature gradient heat treatment of a rod-shaped material.

BACKGROUND OF THE INVENTION

Heat treatment is a process of heating, thermal insulation and cooling of a material in a certain medium to control the performance of the material by changing the surface or the internal structure of the material, and is an extremely important link in material research and application. At present, the conventional research method of the correlation between the heat treatment temperature and the structural performance of the material is performed as follows: preparing a large number of alloy samples with the same composition, and subjecting them to a heat treatment under the same conditions except for changing heat treatment temperatures, which is simple and easy to operate. Such methods, however, have the following disadvantages: 1. large numbers of samples to be prepared and long experimental period. In general, multiple temperature points data is needed in the heat treatment experiment, so a certain number of samples need to be prepared to meet the requirements; each sample must go through a complete heat treatment process, so the workload is large and the experimental period is long. 2. If the temperatures are set discretely, the abnormal behavior may not be observed. For example for many metal materials that are very sensitive to temperature, small temperature changes may cause great changes in phase or structure.

Gradient heat treatment could achieve a continuous temperature gradient in the same sample, and work that could be completed only by several heat treatment experiments in the prior art could be accomplished by the temperature gradient treatment at one time, which not only improves the experimental efficiency, reduces the manpower and material consumption of the experiment, but also has great significance in the improved the development speed of new materials, new products and new processes. Yongquan Ning et. al, from Northwestern Polytechnical University, proposed a gradient heat treatment device for a rod-shaped material and a method for treating a rod-shaped material by using the same (announcement No. CN102912086B). In the method, the upper end of the rod-shaped material is inductively heated utilizing the upper furnace body of the device, and heat is conducted through water cooling at the lower end of the rod-shaped material by the lower furnace body, so as to obtain the axial temperature gradient of the material from the top to the bottom. In CN102912086B, the temperature of each region of the sample could not be precisely controlled, resulting in an uncontrollable temperature gradient. Yunfeng Zou et al. proposed a mold temperature gradient control device (announcement No. CN203356572U), and combined thermocouples and temperature sensors to control the opening and closing of the cooling air pipe, thereby ensuring the designed temperature gradient. However, this patent is only limited to the mold temperature control during the casting and has certain limitations in the field of heat treatment of materials. Moreover, although this technology results in a continuous temperature gradient, due to lateral heat dissipation and other factors, the surface temperature and internal temperature of the material may not be the same, which adversely affects the accuracy of the experimental data. Central South University proposed a continuous temperature gradient heat treatment method for materials (Patent No. ZL104451090), in the method, a trapezoidal graphite cylinder was used to realize a gradient change of resistance, and DC was supplied to both ends of the thermal simulator, to realize the gradient heating and temperature control of the sample in the cylinder. However, because the temperature could only be controlled at a single point, the sample temperature of a part that deviates from the temperature control point fluctuated all the time, which will adversely affect the experimental results.

SUMMARY OF THE INVENTION

An object of the present disclosure is to provide a device and a method for continuous temperature gradient heat treatment of a rod-shaped material. The device of the present disclosure not only brings about improved experimental efficiency, but also makes it possible to precisely control the temperature gradient of the rod-shaped material, and make the surface temperature of the sample consistent with the internal temperature thereof.

To achieve the above object, the present disclosure provides the following technical solutions.

The present disclosure provides a device for continuous temperature gradient heat treatment of a rod-shaped material, including a furnace body, a vacuum pumping equipment, an upper heating power supply and a lower heating power supply. The vacuum pumping equipment, the upper heating power supply and the lower heating power supply are provided outside the furnace body. A sidewall of the furnace body is provided with an infrared thermal imaging temperature measuring window 5 and an air outlet 6. The vacuum pumping equipment is communicated with the air outlet 6.

The furnace body is provided with a water-cooling joint 1, an upper heating zone 2, a lower heating zone 3, and an annular radiation screen 4. The water-cooling joint 1 is fixed onto the top of the furnace body.

The annular radiation screen 4 is arranged between the upper heating zone 2 and the lower heating zone 3. A distance between the upper end of the annular radiation screen 4 and the bottom of the upper heating zone 2 is in the range of 0-2 mm, and a distance between the lower end of the annular radiation screen 4 and the top of the lower heating zone 3 is in the range of 0-2 mm. The annular radiation screen 4 is provided with a slit with a width of 1-2 mm along an axial direction. The slit has a length the same as that of the annular radiation screen 4. The infrared thermal imaging temperature measuring window 5 is configured to match with the position of the slit.

The upper heating zone 2 is provided with an upper heating rod 71 and an upper closed heat insulation plate 81, and the lower heating zone 3 is provided with a lower heating rod 72 and a lower closed heat insulation plate 82. The upper heating rod 71 in the upper heating zone 2 is connected to the upper heating power supply, and the lower heating rod 72 in the lower heating zone 3 is connected to the lower heating power supply. The upper heating rod 71 and the lower heating rod 72 are enclosed by the upper closed heat insulation plate 81 and the lower closed heat insulation plate 82 respectively to form closed heating zones. An upper wall and a lower wall of the upper closed heat insulation plate 81 and an upper wall of the lower closed heat insulation plate 82 are respectively provided with a passage for the rod-shaped material to pass through.

An axis of the annular radiation screen 4 coincides with an axis of the rod-shaped material and a vertical centerline of the upper heating zone 2 and the lower heating zone 3. The annular radiation screen 4 is not in contact with the rod-shaped material.

In some embodiments, the annular radiation screen 4 is made of tantalum or molybdenum, and has a thickness of 0.3-0.6 mm; a distance between the annular radiation screen 4 and the surface of the rod-shaped material is in the range of 10-20 mm.

In some embodiments, the upper closed heat insulation plate 81 and the lower closed heat insulation plate 82 are made of graphite felt and have a thickness of 5-10 mm independently.

In some embodiments, a gap between the rod-shaped material and the passage for the rod-shaped material to pass through which is provided in the upper closed heat insulation plate 81 or the lower closed heat insulation plate 82, is less than 3 mm independently.

In some embodiments, a moving guide rail 9 is further provided on an inner wall of the furnace body, and at least one of the upper heating zone 2 and the lower heating zone 3 is movable up and down along the moving guide rail 9.

In some embodiments, the device further includes a circulating water device, and the circulating water device is in communication with the water-cooling joint 1.

The present disclosure provides a method for continuous temperature gradient heat treatment of a rod-shaped material using the device for continuous temperature gradient heat treatment of a rod-shaped material, including the following steps:

successively passing the rod-shaped material from bottom to top through the upper wall of the lower heating zone 3, the annular radiation screen 4 and the lower wall and the upper wall of the upper heating zone 2, fixing an upper end of the rod-shaped material onto the water-cooling joint 1, and taking a corresponding part of the rod-shaped material that is between the upper heating zone 2 and the lower heating zone 3 as a standard sample section;

vacuuming the furnace body by means of the vacuum pumping equipment; turning on the upper heating power supply and the lower heating power supply, heating a part of the rod-shaped material that is located in the upper heating zone 2 by means of the upper heating rod 71, and heating a part of the rod-shaped material that is located in the lower heating zone 3 by means of the lower heating rod 72, causing heat to be transferred along an axial direction of the rod-shaped material, so as to form a continuous temperature gradient in the standard sample section of the rod-shaped material, wherein set heating temperatures in the upper heating zone 2 and the lower heating zone 3 correspond to endpoint temperatures of the temperature gradient of the standard sample section of the rod-shaped material; and measuring a continuous temperature gradient distribution situation of the standard sample section through the infrared thermal imaging temperature measuring window 5, and carrying out thermal insulation when the continuous temperature gradient distribution is stable.

In some embodiments, the method further includes turning on the circulating water before heating under the condition that the device for continuous temperature gradient heat treatment of a rod-shaped material further includes a circulating water device.

In some embodiments, vacuuming the furnace body by means of the vacuum pumping equipment comprises vacuuming the furnace body to a pressure of not more than 3.3×10−2 Pa. Herein, the pressure is represented by a gauge pressure.

In some embodiments, the method further includes before heating the rod-shaped material, providing a thermocouple on an outer wall of the standard sample section of the rod-shaped material, and correcting the continuous temperature gradient measured by the infrared thermal imaging by means of the thermocouple after obtaining a stable continuous temperature gradient.

The present disclosure provides a device for continuous temperature gradient heat treatment of a rod-shaped material, including a furnace body, a vacuum pumping equipment, an upper heating power supply and a lower heating power supply. The vacuum pumping equipment, the upper heating power supply and the lower heating power supply are provided outside the furnace body. A sidewall of the furnace body is provided with an infrared thermal imaging temperature measuring window 5 and an air outlet 6. The vacuum pumping equipment is communicated with the air outlet 6. The furnace body is provided with a water-cooling joint 1, an upper heating zone 2, a lower heating zone 3, and an annular radiation screen 4. The water-cooling joint 1 is fixed onto the top of the furnace body. The annular radiation screen 4 is arranged between the upper heating zone 2 and the lower heating zone 3. A distance between the upper end of the annular radiation screen 4 and the bottom of the upper heating zone 2 is in the range of 0-2 mm, and a distance between the lower end of the annular radiation screen 4 and the top of the lower heating zone 3 is in the range of 0-2 mm. The annular radiation screen 4 is provided with a slit with a width of 1-2 mm along an axial direction, and the slit has a length same as that of the annular radiation screen 4. The infrared thermal imaging temperature measuring window 5 is configured to match with the position of the slit. The upper heating zone 2 is provided with an upper heating rod 71 and an upper closed heat insulation plate 81, and the lower heating zone 3 is provided with a lower heating rod 72 and a lower closed heat insulation plate 82. The upper heating rod 71 in the upper heating zone 2 is connected to the upper heating power supply, and the lower heating rod 72 in the lower heating zone 3 is connected to the lower heating power supply. The upper closed heat insulation plate 81 and the lower closed heat insulation plate 82 respectively enclose the upper heating rod 71 and the lower heating rod 72 to form closed heating zones. An upper wall and a lower wall of the upper closed heat insulation plate 81 and an upper wall of the lower closed heat insulation plate 82 are respectively provided with a passage for the rod-shaped material to pass through. An axis of the annular radiation screen 4 coincides with an axis of the rod-shaped material and a vertical centerline of the upper heating zone 2 and the lower heating zone 3. The annular radiation screen 4 is not in contact with the rod-shaped material.

The furnace body includes an upper heating zone 2 and the lower heating zone 3 inside, which are independently controlled in temperature by means of the upper heating power supply and the lower heating power supply. Moreover, both the upper heating zone 2 and the lower heating zone 3 are closed heating zones. The closed heat insulation plates could prevent heat loss and ensure precise temperature control of the upper heating zone and the lower heating zone. The temperature difference between the upper heating zone and the lower heating zone is defined as the temperature gradient of the middle standard sample section of the rod-shaped material. In the present disclosure, the temperature gradient is precisely controlled by precisely controlling the temperatures of the upper heating zone and the lower heating zone.

In the device according to the present disclosure, vacuum pumping equipment is included, which could make the rod-shaped material conduct heat transfer under vacuum and avoid thermal convection; the annular radiation screen 4 is configured between the upper heating zone and the lower heating zone, which could inhibit the lateral heat dissipation of the standard sample section of the rod-shaped material between the upper heating zone 2 and the lower heating zone 3, and make the heat be transferred along the longitudinal direction (the axial direction of the rod-shaped material); moreover, the rod-shaped material is not in contact with the annular radiation screen 4 to avoid heat conduction. With the function of the three aspects above, the standard sample section of the rod-shaped material between the upper heating zone and the lower heating zone conduct one-dimensional heat transfer along the axial direction, so as to ensure that the surface temperature of the standard sample section is consistent with the center temperature thereof.

In some embodiments, the device of the present disclosure further includes a moving guide rail 9. At least one of the upper heating zone 2 and the lower heating zone 3 is movable up and down along the moving guide rail 9, thus being adaptable to samples of different specifications.

In some embodiments, the device includes a circulating water device. On the one hand, the circulating water device could reduce the temperature of the water-cooling joint 1 and protect the water-cooling joint 1; on the other hand, it could adjust the temperature gradient range and adjust the heat balance.

The present disclosure provides a method for continuous temperature gradient heat treatment of a rod-shaped material. The data could be obtained from one sample, which needs to be obtained from multiple samples in a traditional method, thereby greatly improving the experimental efficiency, and reducing the manpower, material input and energy consumption.

In some embodiments, the method further includes before heating the rod-shaped material, providing a thermocouple on an outer wall of the standard sample section of the rod-shaped material, and correcting the continuous temperature gradient measured by the infrared thermal imaging by the thermocouple after obtaining a stable continuous temperature gradient, to further improve the accuracy of temperature control.

BRIEF DESCRIPTION OF THE DRAWINGS

In FIG. 1, 1 represents a water-cooling joint, 2 represents an upper heating zone, 3 represents a lower heating zone, 4 represents an annular radiation screen, 5 represents an infrared thermal imaging temperature measuring window, 6 represents an air outlet, 71 represents an upper heating rod, 72 represents a lower heating rod, 81 represents an upper closed heat insulation plate, 82 represents a lower closed heat insulation plate, 9 represents a moving guide rail, 10 represents a thermocouple, 11 represents an electrode, and 12 represents a water-cooling rod;

DETAILED DESCRIPTION OF THE PREFERRED EMBODIMENTS

Figure 1:
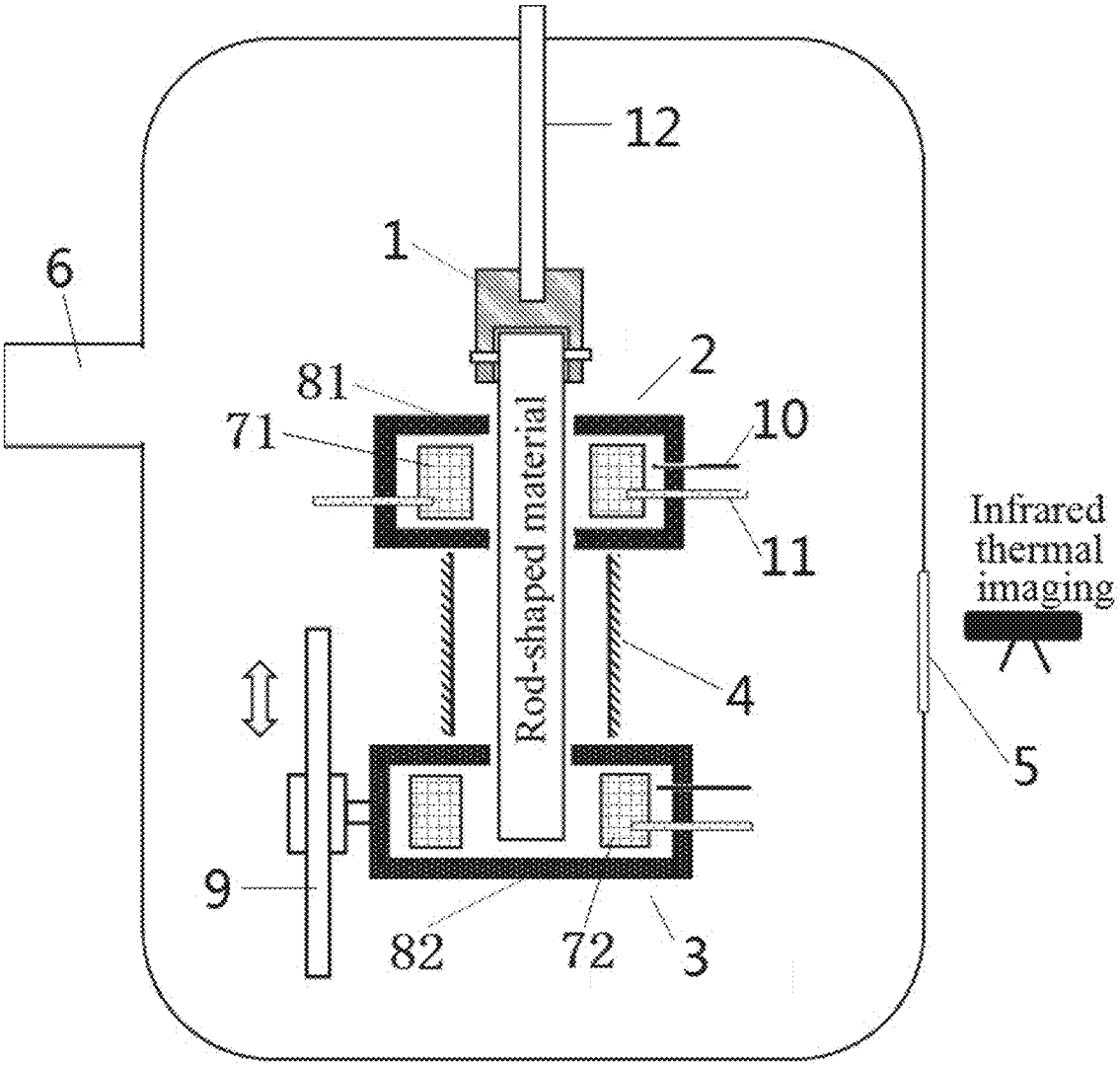
FIG. 1 is a structural diagram of the device for continuous temperature gradient heat treatment of a rod-shaped material according to the present disclosure.

As shown in FIG. 1, the present disclosure provides a device for continuous temperature gradient heat treatment of a rod-shaped material, including a furnace body, a vacuum pumping equipment, an upper heating power supply and a lower heating power supply. The vacuum pumping equipment, the upper heating power supply and the lower heating power supply are provided outside the furnace body. A sidewall of the furnace body is provided with an infrared thermal imaging temperature measuring window 5 and an air outlet 6. Air outlet 6 is communicated with the vacuum pumping equipment.

The furnace body is provided with a water-cooling joint 1, an upper heating zone 2, a lower heating zone 3, and an annular radiation screen 4. The water-cooling joint 1 is fixed onto the top of the furnace body.

The annular radiation screen 4 is arranged between the upper heating zone 2 and the lower heating zone 3. A distance between the upper end of the annular radiation screen 4 and the bottom of the upper heating zone 2 is in the range of 0-2 mm, and a distance between the lower end of the annular radiation screen 4 and a top of the lower heating zone 3 is in the range of 0-2 mm. The annular radiation screen 4 is provided with a slit with a width of 1-2 mm along an axial direction, and the slit has a height same as that of the annular radiation screen 4. The infrared thermal imaging temperature measuring window 5 is configured to match with the position of the slit.

The upper heating zone 2 is provided with an upper heating rod 71 and an upper closed heat insulation plate 81, and the lower heating zone 3 is provided with a lower heating rod 72 and a lower closed heat insulation plate 82. The upper heating rod 71 in the upper heating zone 2 is connected to the upper heating power supply, and the lower heating rod 72 in the lower heating zone 3 is connected to the lower heating power supply. The upper closed heat insulation plate 81 and the lower closed heat insulation plate 82 respectively encloses the upper heating rod 71 and the lower heating rod 72, to form closed heating zones. An upper wall and a lower wall of the upper closed heat insulation plate 81 and an upper wall of the lower closed heat insulation plate 82 are respectively provided with a passage for the rod-shaped material to pass through.

An axis of the annular radiation screen 4 coincides with an axis of the rod-shaped material and a vertical centerline of the upper heating zone 2 and the lower heating zone 3. The annular radiation screen 4 is not in contact with the rod-shaped material.

The device for continuous temperature gradient heat treatment of a rod-shaped material includes vacuum pumping equipment, and the vacuum pumping equipment is used for vacuuming the furnace body to a vacuum state. There are no special requirements for the vacuum pumping equipment, and the vacuum pumping equipment well known in the art may be used.

The device for continuous temperature gradient heat treatment of a rod-shaped material includes an upper heating power supply and a lower heating power supply. The upper heating power supply and the lower heating power supply of the disclosure respectively provide heat sources for the upper heating rod 71 in the upper heating zone 2 and the lower heating rod 72 in the lower heating zone 3, and the rod-shaped material is heated by the heat radiated by the heating rods, thereby realizing the independent temperature control of the upper heating zone 2 and the lower heating zone 3. In the present disclosure, there are no special requirements for the structure of the upper heating power supply and the lower heating power supply, and the heating power supplies well known in the art may be used. In some embodiments of the disclosure, the upper heating power supply and the lower heating power supply respectively include a thermocouple 10, an electrode 11 and a control unit. The temperatures are measured by the thermocouple and the temperature information is fed back to the control unit of power supplies, thereby realizing the temperature control.

The device for continuous temperature gradient heat treatment of a rod-shaped material includes a furnace body. A sidewall of the furnace body is provided with an infrared thermal imaging temperature measuring window 5 and an air outlet 6. Air outlet 6 is communicated with the vacuum pumping equipment. The infrared thermal imaging temperature measuring window 5 is configured to match with the position of the slit in the annular radiation screen 4. In the disclosure, the infrared thermal imaging temperature measuring window 5 is configured to match with the slit in the annular radiation screen 4, thereby realizing the measurement of the continuous temperature gradient of the standard sample section between the upper heating zone and the lower heating zone.

The device for continuous temperature gradient heat treatment of a rod-shaped material is provided, and the furnace body is provided with a water-cooling joint 1, an upper heating zone 2, a lower heating zone 3, and an annular radiation screen 4.

In the present disclosure, the water-cooling joint 1 is fixed onto the top of the furnace body. In the present disclosure, there are no special requirements for the fixing mode of the water-cooling joint 1, as long as the water-cooling joint 1 could be fixed to the top of the furnace body. The water-cooling joint 1 is used for fixing the rod-shaped material. In some embodiments of the disclosure, the water-cooling joint 1 is nut shaped, and the rod-shaped material is connected with the water-cooling joint 1 through threads. In the disclosure, the water-cooling joint 1 could be used to fix a rod-shaped material with a diameter of 7-16 mm.

In one embodiment of the disclosure, the device for continuous temperature gradient heat treatment of a rod-shaped material also includes a circulating water device. The circulating water device is communicated with the water-cooling joint 1. In some embodiments of the disclosure, the circulating water device is communicated with the water-cooling joint through the water-cooling rod 12 passing through the top of the furnace body. In some embodiments, the water-cooling rod 12 is in permanent communication with the water-cooling joint 1 through a thread. In the disclosure, the water-cooling rod 12 has a hollow structure. In the disclosure, there are no special requirements on the material and size of the water-cooling rod 12, as long as the material and size of the water-cooling rod 12 could be matched with those of the water-cooling joint 1 and the circulating water device. In the disclosure, there are no special limitations on the circulating water device, and any device is well known in the art that could provide circulating water could be used. On the one hand, the circulating water device is to reduce the temperature of the water-cooling joint and protect the water-cooling joint; on the other hand, it is conducive to adjusting the temperature gradient range and thereby regulating the heat balance.

The furnace body of the present disclosure includes the upper heating zone 2 and the lower heating zone 3. In the disclosure, the upper heating zone 2 is provided with an upper heating rod 71 and an upper closed heat insulation plate 81, and the lower heating zone 3 is provided with a lower heating rod 72 and a lower closed heat insulation plate 82. In some embodiments of the disclosure, the heating rods are made of silicon carbide rod. When a silicon carbide rod is used as the heating rod, the maximum heating temperature could be 1450 □C and the cumulative working time could reach more than 1000 hours. In the disclosure, there are no special requirements for the number of the heating rods in the heating zone, as long as uniform heating could be realized. In some embodiments of the disclosure, the heating rods are symmetrically distributed in the heating zone, and the heating rods are not in contact with the rod-shaped material during heating, and the rod-shaped material is heated by radiation. In the disclosure, the upper heating power supply is connected with the heating rods in the upper heating zone, and the lower heating power supply is connected with the heating rods in the lower heating zone.

In the present disclosure, the upper heating rod 71 and the lower heating rod 72 are enclosed by the upper closed heat insulation plate 81 and the lower closed heat insulation plate 82 respectively to form closed heating zones (that is to say, both the upper heating zone and the lower heating zone are closed heating zones). An upper wall and a lower wall of the upper closed heat insulation plate 81 and an upper wall of the lower closed heat insulation plate 82 are respectively provided with a passage for the rod-shaped material to pass through. In one embodiment of the disclosure, the lower wall of the lower closed heat insulation plate 82 may be provided with a passage through which the rod-shaped material passes, or it may be provided without a passage through which the rod-shaped material passes. In some embodiments of the disclosure, the gap between the passages and the rod-shaped material is independently less than 3 mm, and more preferably, they are in a matching contact without a gap to prevent heat loss and affect the temperature accuracy. In some embodiments of the disclosure, the upper closed heat insulation plate 81 and the lower closed heat insulation plate 82 are cylinder-structured, and the formed closed heating zones are cylindrical heating zones, which is conducive to realizing the symmetrical heating of the sample. In some embodiments of the disclosure, the upper closed heat insulation plates 81 and the lower closed heat insulation plate 82 are made of graphite felt. In some embodiments of the disclosure, the upper closed heat insulation plates 81 and the lower closed heat insulation plate 82 independently have a thickness of 5-10 mm. In the disclosure, there are no special requirements for the size of the upper closed heat insulation plate 81 and the lower closed heat insulation plate 82, as long as the function of preventing heat loss could be realized. In some embodiments of the disclosure, the size of the upper closed heat insulation plate is Ø40×50 mm, and the size of the lower closed heat insulation plate is Ø40×80 mm (i.e., the size of heating zones). In the disclosure, the closed heat insulation plates are to prevent heat loss and ensure the precise control of the temperature of the upper heating zone and the lower heating zone, which combines with the independent temperature control of the upper heating power supply and the lower heating power supply, so that the temperature gradient of the middle standard sample section of the rod-shaped material could be precisely controlled according to the temperature settings of the upper heating zone and the lower heating zone.

The device of the present disclosure includes an annular radiation screen 4. In some embodiments of the disclosure, the annular radiation screen 4 is located between the upper heating zone 2 and the lower heating zone 3. A distance between the upper end of the annular radiation screen 4 and the bottom of the upper heating zone 2 is in the range of 0-2 mm, preferably 0 mm. A distance between the lower end of the annular radiation screen 4 and the top of the lower heating zone 3 is in the range of 0-2 mm, preferably 0 mm. The annular radiation screen 4 is provided with a slit with a width of 1-2 mm along an axial direction, and the slit has a length of the same as that of the annular radiation screen 4, which is used for infrared thermal imaging temperature measurement.

In some embodiments of the present disclosure, the annular radiation screen 4 is made of tantalum or molybdenum. In some embodiments, the annular radiation screen 4 has a thickness of 0.3-0.6 mm. In the disclosure, the annular radiation screen with a material and thickness as defined above is conducive to reducing the thermal radiation, thus promoting the one-dimensional heat transfer of the standard sample section, so as to ensure that the surface temperature of the standard sample section is consistent with center temperature thereof.

In the present disclosure, the rod-shaped material successively passes from the bottom to top through the upper wall of the lower heating zone 3, the annular radiation screen 4 and the lower wall and the upper wall of the upper heating zone 2, and an upper end of the rod-shaped material is fixed into the water-cooling joint 1. An axis of the annular radiation screen 4 coincides with an axis of the rod-shaped material and a vertical centerline of the upper heating zone 2 and the lower heating zone 3. In the present disclosure, the annular radiation screen 4 is not in contact with the rod-shaped material, and the distance between the annular radiation screen 4 and the surface of the rod-shaped material is in the range of 10-20 mm. The rod-shaped material is not in contact with the circular radiation screen 4, which avoids heat conduction and is conducive to the one-dimensional heat transfer along the axial direction of the standard sample section of the rod-shaped material in the upper and lower heating zones, thus ensuring that the surface temperature of the standard sample section is consistent with and the center temperature thereof.

In one embodiment of the disclosure, the inner wall of the furnace body is also provided with a moving guide rail 9, and at least one of the upper heating zone 2 and the lower heating zone 3 is movable up and down along the moving guide rail 9. In some embodiments, the upper heating zone 2 is fixed, and the lower heating zone 3 is movable up and down along the moving guide rail 9, being adaptable to the heating of samples of different specifications. In the disclosure, there are no special limitations on the moving guide rail and the connection relationship between the moving guide rail and the heating zones, as long as the up and down movement of the upper heating zone and/or the lower heating zone could be realized. Specifically, an axially movable sliding block is arranged on the moving guide rail, which is connected with the lower heating zone.

The present disclosure provides a method for continuous temperature gradient heat treatment of a rod-shaped material using the device for continuous temperature gradient heat treatment of a rod-shaped material, including the following steps:

successively passing the rod-shaped material from bottom to top through the upper wall of the lower heating zone 3, the annular radiation screen 4 and the lower wall and the upper wall of the upper heating zone 2; fixing an upper end of the rod-shaped material onto the water-cooling joint 1; and taking a corresponding part of the rod-shaped material that is between the upper heating zone 2 and the lower heating zone 3 as a standard sample section;

vacuuming the furnace body by means of the vacuum pumping equipment, turning on the upper heating power supply and the lower heating power supply, heating a part of the rod-shaped material that is located in the upper heating zone 2 by means of the upper heating rod 71, and heating a part of the rod-shaped material that is located in the lower heating zone 3 by means of the lower heating rod 72, causing heat to be transferred along an axial direction of the rod-shaped material, so as to form a continuous temperature gradient in the standard sample section of the rod-shaped material, wherein set heating temperatures in the upper heating zone 2 and the lower heating zone 3 respectively correspond to endpoint temperatures of the temperature gradient of the standard sample section of the rod-shaped material; and measuring a continuous temperature gradient distribution of the standard sample section through the infrared thermal imaging temperature measuring window 5, and carrying out thermal insulation when the continuous temperature gradient distribution is stable.

In the present disclosure, the rod-shaped material successively passes from the bottom to top through the upper wall of the lower heating zone 3, the annular radiation screen 4 and the lower wall and the upper wall of the upper heating zone 2, and an upper end of the rod-shaped material is fixed onto the water-cooling joint 1.

In the disclosure, there are no special requirements for the rod-shaped material, and the rod-shaped material can be selected according to the actual requirements. In some embodiments of the disclosure, the rod-shaped material is a cylinder with a uniform diameter. In some embodiments, the diameter of the rod-shaped material is in the range of 7-18 mm.

In some embodiments of the disclosure, when the lower wall of the lower heating zone 3 is provided with a passage through which the rod-shaped material passes, the method of the present disclosure also includes passing the rod-shaped material through the lower wall of the lower heating zone 3, so as to ensure that the lower heating zone 3 is a closed heating zone, which is conducive to controlling the temperature accuracy of the lower heating zone.

In the disclosure, the corresponding part of the rod-shaped material that is between the upper heating zone 2 and the lower heating zone 3 is taken as a standard sample section. The length of the standard sample section is the same as the distance between the upper heating zone and the lower heating zone. When the inner wall of the furnace body of the device for continuous temperature gradient heat treatment of a rod-shaped material is provided with a moving guide rail 9, at least one of the upper heating zone 2 and the lower heating zone 3 is movable up and down along the moving guide rail 9. In some embodiments of the disclosure, the length of the standard sample section is adjusted by adjusting the upper and lower positions of the upper heating zone and/or the lower heating zone. In the disclosure, there are no special requirements for the length of the standard sample section, and it can be selected according to the actual demand. In some embodiments of the disclosure, the standard sample section has a length of 80 mm.

In the present disclosure, after the rod-shaped material is fixed, the furnace body is vacuumed by means of the vacuum pumping equipment, and then the upper heating power supply and the lower heating power supply are turned on. The part of the rod-shaped material in the upper heating zone 2 is heated by means of the upper heating rod 71, and the part of the rod-shaped material in the lower heating zone 3 is heated by means of the lower heating rod 72, and the heat is transferred along the axial direction of the rod-shaped material, forming a continuous temperature gradient in the standard sample section of the rod-shaped material.

In some embodiments of the disclosure, vacuuming the furnace body by means of the vacuum pumping equipment comprises vacuuming to a pressure of not more than 3.3× 10−2 Pa. In the present disclosure, vacuuming is to reduce heat convection.

In some embodiments of the disclosure, before the rod-shaped material is heated, the method further includes providing a thermocouple on an outer wall of the standard sample section of the rod-shaped material and correcting the continuous temperature gradient measured by the infrared thermal imaging by means of the thermocouple after obtaining a stable continuous temperature gradient. In some embodiments of the disclosure, the thermocouple is at both ends of the standard sample section of the rod-shaped material.

In the disclosure, the set heating temperatures in the upper heating zone 2 and the lower heating zone 3 correspond to the endpoint temperatures of the temperature gradient of the standard sample section of the rod-shaped material. Under the condition that a continuous temperature gradient between 1000° C. and 1300° C. is required, one of the upper heating zone and the lower heating zone is set as 1000° C. and the other one is set as 1300° C. In the disclosure, the set heating temperatures in the upper heating zone and the lower heating zone also correspond to the insulation temperatures in the upper heating zone and the lower heating zone during the subsequent insulation process.

In the disclosure, because of the temperature difference between the upper heating zone and the lower heating zone, a continuous temperature gradient between the upper heating zone and the lower heating zone is formed in the rod-shaped material. Heat is transferred under vacuum in the standard sample section, which avoids heat convection; an annular radiation screen is set between the upper heating zone and the lower heating zone, which prevents the lateral heat dissipation of the standard sample section and makes the heat transfer along the longitudinal direction (the axial direction of the rod-shaped material); the rod-shaped material is not in contact with the annular radiation screen, which avoids heat conduction. The combined function of the three aspects above makes it possible that heat is transferred one-dimensionally along the axial direction in the standard sample section between the upper heating zone and the lower heating zone, thereby ensure that the surface temperature of the standard sample section is consistent with the center temperature thereof.

After the continuous temperature gradient is formed in the standard sample section of the rod-shaped material, the continuous temperature gradient distribution of the standard sample section is measured by the infrared thermal imaging temperature measuring window 5, and thermal insulation is carried out after the continuous temperature gradient distribution is stable. In the disclosure, when the set temperatures are reached in the upper heating zone and the lower heating zone, a stable continuous temperature gradient would quickly be formed (within 10 min) in the standard sample section. In some embodiments of the present disclosure, a stable continuous temperature gradient distribution is formed when no temperature changes of a particular temperature measuring point of the standard sample section are detected by the infrared thermal imaging.

In the present disclosure, after a stable continuous temperature gradient is formed, the rod-shaped material is thermally insulated. In the disclosure, there are no special requirements for the thermal insulation time, and the thermal insulation time can be selected according to the actual demand. In some embodiments, the method further includes, after the thermal insulation, cooling the rod-shaped material after heat treatment. In the disclosure, there are no special requirements for the cooling mode, and the cooling mode can be selected according to the actual demand.

In the disclosure, after a stable continuous temperature gradient, the method also includes correcting the obtained stable continuous temperature gradient. In some embodiments of the disclosure, correcting the obtained stable continuous temperature gradient includes correcting all the infrared thermal imaging temperature measurement results with the detection differences of the temperature measurement points, with the temperature measured by the thermocouple arranged on the outer wall of the standard sample section as the standard. Because the thermocouples are used for direct contact temperature measurement and have higher accuracy, in the disclosure, the thermocouples are used to correct the continuous temperature gradient measured by infrared thermal imaging, ensuring the accuracy of temperature. In the disclosure, the correction process could be carried out during the thermal insulation or after the thermal insulation and is only aimed to correct the stable continuous temperature gradient (however, it is necessary to read the temperature results measured by the thermocouple after obtaining a stable continuous temperature gradient and before the end of thermal insulation).

In the disclosure, when the device for continuous temperature gradient heat treatment of a rod-shaped material also includes a circulating water device, the method also includes turning on the circulating water before heating, till that the heat treatment is completed, and other steps same as the above technical solution, which will not be repeated here. In the disclosure, there are no special requirements for the flow rate of the circulating water, and the flow rate of the circulating water could be adjusted by those skilled in the art according to the actual situation. On the one hand, the circulating water is to reduce the temperature of the water-cooling joint and prevent the water-cooling joint from being scrapped prematurely due to high temperature; on the other hand, it is to adjust the temperature gradient range and the heat balance.

In order to facilitate those skilled in the art to better understand the technical solution of the disclosure, the device and the method for continuous temperature gradient heat treatment of a rod-shaped material of the disclosure are described with reference to FIG. 1. As shown in FIG. 1, the furnace body is provided with a water-cooling joint 1, an upper heating zone 2, a lower heating zone 3, and an annular radiation screen 4. A sidewall of the furnace body is provided with an infrared thermal imaging temperature measuring window 5 and an air outlet 6. The upper heating zone 2 is provided with an upper heating rod 71 and an upper closed heat insulation plate 81, and the lower heating zone 3 is provided with a lower heating rod 72 and a lower closed heat insulation plate 82. The upper heating power supply (not shown) is connected with the upper heating rod 71 in the upper heating zone 2, and the lower heating power supply (not shown) is connected with the lower heating rod 72 in the lower heating zone 3. The upper closed heat insulation plate 81 and the lower closed heat insulation plate 82 respectively enclose the upper heating rod 71 and the lower heating rod 72 to form closed heating zones. An upper wall and a lower wall of the upper closed heat insulation plate 81 and an upper wall of the lower closed heat insulation plate 82 are respectively provided with a passage for the rod-shaped material to pass through. The annular radiation screen 4 is provided with a slit with a width of 1-2 mm along an axial direction (not shown). The lower heating zone in FIG. 1 is movable up and down along the moving guide rail 9. The circulating water device not shown) is connected with the water-cooling joint 1 through the water-cooling rod 12. The vacuum pumping equipment (not shown) is communicated with the air outlet 6.

In the present disclosure, the rod-shaped material successively passes from the bottom to top through the upper wall of the lower heating zone 3, the annular radiation screen 4, and the lower wall and the upper wall of the upper heating zone 2, and an upper end of the rod-shaped material is fixed onto the water-cooling joint 1. In the disclosure, the furnace body is vacuumed by means of the vacuum pumping equipment, and then the upper heating power supply (only part of the thermocouple 10 and electrode 11 of the heating power supply are shown) and the lower heating power supply (only part of the thermocouple 10 and electrode 11 of the heating power supply are shown) are turned on. The part of the rod-shaped material in the upper heating zone 2 is heated by means of the upper heating rod 71, and the part of the rod-shaped material in the lower heating zone 3 is heated by means of the lower heating rod 72. The heat is transferred along the axial direction of the rod-shaped material. The set heating temperatures in the upper heating zone 2 and the lower heating zone 3 correspond to the endpoint temperatures of the temperature gradient of the standard sample section of the rod-shaped material, and a continuous temperature gradient is formed in the standard sample section of the rod-shaped material. The continuous temperature gradient distribution situation of the standard sample section is measured by the infrared thermal imaging temperature measuring window 5, and thermal insulation is carried out after the continuous temperature gradient distribution is stable.

The device and method for continuous temperature gradient heat treatment of a rod-shaped material of the disclosure are described in detail in conjunction with the example below, but it shall not be understood as limiting the protection scope of the disclosure.

Example 1

The device shown in FIG. 1 was used. In the furnace body, a water-cooling joint 1, an upper heating zone 2 (with a dimension of Ø40×50 mm), a lower heating zone 3 (with a dimension of Ø40×80 mm), and an annular radiation screen 4 (which is made of Ta, have a thickness of 0.3 mm, and is provided with a slit with a width of 1 mm along the axial direction) are arranged. The annular radiation screen 4 is arranged between the upper heating zone 2 and the lower heating zone 3. A distance between the upper end of the annular radiation screen 4 and the bottom of the upper heating zone 2 is 0 mm (namely, a close contact), and a distance between the lower end of the annular radiation screen 4 and the top of the lower heating zone 3 is 0 mm (namely, a close contact). The sidewall of the furnace body is provided with an infrared thermal imaging temperature measuring window 5 and an air outlet 6. The upper heating zone 2 is provided with an upper heating rod 71 (specifically, a silicon carbide rod) and an upper closed heat insulation plate 81 (which is made of graphite felt, and has a thickness of 5 mm), and the lower heating zone 3 is provided with a lower heating rod 72 (specifically, a silicon carbide rod) and a lower closed heat insulation plate 82 (which is made of graphite felt, and has a thickness of 5 mm). The upper closed heat insulation plate 81 and the lower closed heat insulation plate 82 respectively enclose the upper heating rod 71 and the lower heating rod 72 to form closed heating zones. The lower heating zone 3 is movable up and down along the moving guide rail 9. The circulating water device (not shown) is connected with the water-cooling joint 1 through the water-cooling rod 12. The vacuum pumping equipment (not shown) is communicated with the air outlet 6.

Before the gradient heat treatment: the rod-shaped material (having a diameter of 18 mm) passes successively from bottom to top through the upper wall of the lower heating zone 3, the annular radiation screen 4, and the lower wall and the upper wall of the upper heating zone 2 (the gap between the rod-shaped material and the upper heating zone 2 is 3 mm, and the gap between the rod-shaped material and the lower heating zone 3 is 3 mm), and is fixed onto the water-cooling joint 1. The corresponding part of the rod-shaped material that is between the upper heating zone and the lower heating zone is taken as a standard sample section. The length of the standard sample section is set as 80 mm by adjusting the position of the lower heating zone 3 up and down by means of moving the guide rail 9. One thermocouple (not shown) is arranged respectively at each end of the standard section of the rod-shaped material for subsequent correction of infrared thermal imaging temperature measurement. Turn on circulating water, close the furnace door, and the furnace body is vacuumed to a pressure of 3.3×10−2 Pa by means of the vacuum pumping equipment.

Start of gradient heat treatment: both ends of the rod-shaped material are heated by means of the upper heating rod 71 and the lower heating rod 72. The set heating temperature in the upper heating zone 2 is 800° C., and the set heating temperature in the lower heating zone 3 is 1300° C. After the lower heating zone 3 is heated to 1300° C. and a stable continuous temperature gradient is achieved by monitoring the standard sample section by the infrared thermal imaging (by means of the infrared thermal imaging temperature measuring window on the sidewall of the furnace body), the thermal insulation starts. During the thermal insulation, the temperature of the standard sample section is measured with the combination of infrared thermal imaging and thermocouples temperature measurement, in which, the temperature of the whole standard sample section is measured by infrared thermal imaging, and temperatures of the two ends are measured by the thermocouples. The thermal insulation time is 30 minutes. After the thermal insulation, the infrared thermal imaging temperature measurement is corrected with results measured by the thermocouples.

End of gradient heat treatment: the heating switch is turned off, the circulating water is adjusted, and the rod-shaped material is taken out in the reverse order compared with its loading.

Figure 2:
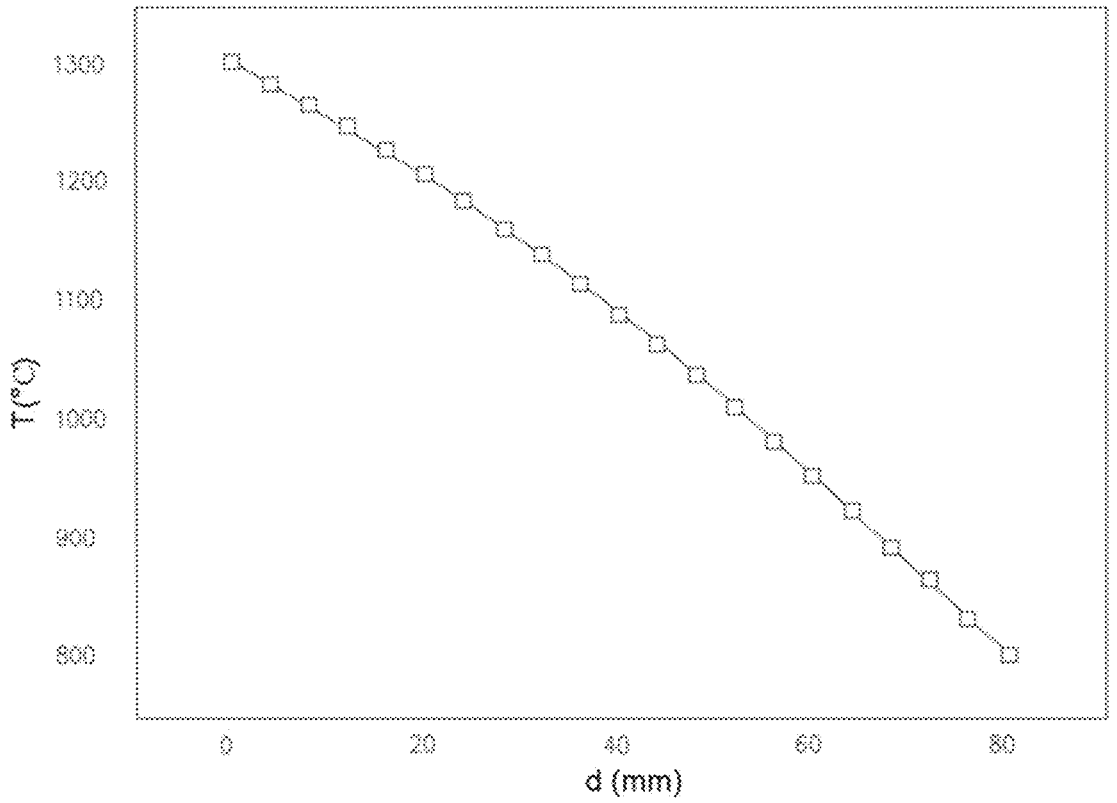
FIG. 2 illustrates the continuous temperature gradient distribution of the standard sample section measured by the thermocouple in combination with infrared thermal imaging.

FIG. 2 shows the continuous temperature gradient distribution of the standard sample section measured by the thermocouple in combination with infrared thermal imaging. FIG. 2 shows that a continuous temperature gradient is formed in the standard sample section of the rod-shaped material by using the method of the present disclosure.

Figure 3:
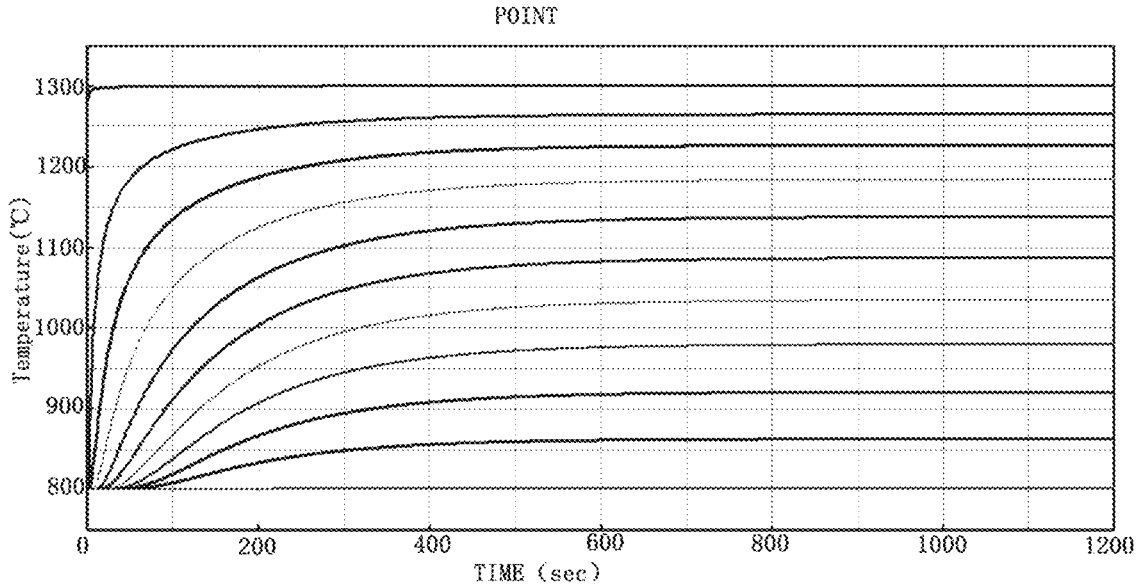
FIG. 3 shows a plot of the temperature of different points in the upper heating zone, the lower heating zone, and the standard sample section versus time.

FIG. 3 shows a plot of the temperature of different points in the upper heating zone, the lower heating zone, and the standard sample section versus time. It can be seen from FIG. 3 that when the set temperatures are reached in the upper heating zone and the lower heating zone, a stable continuous temperature gradient is formed in the standard sample section during a short period of time (400 s).

Figure 4:
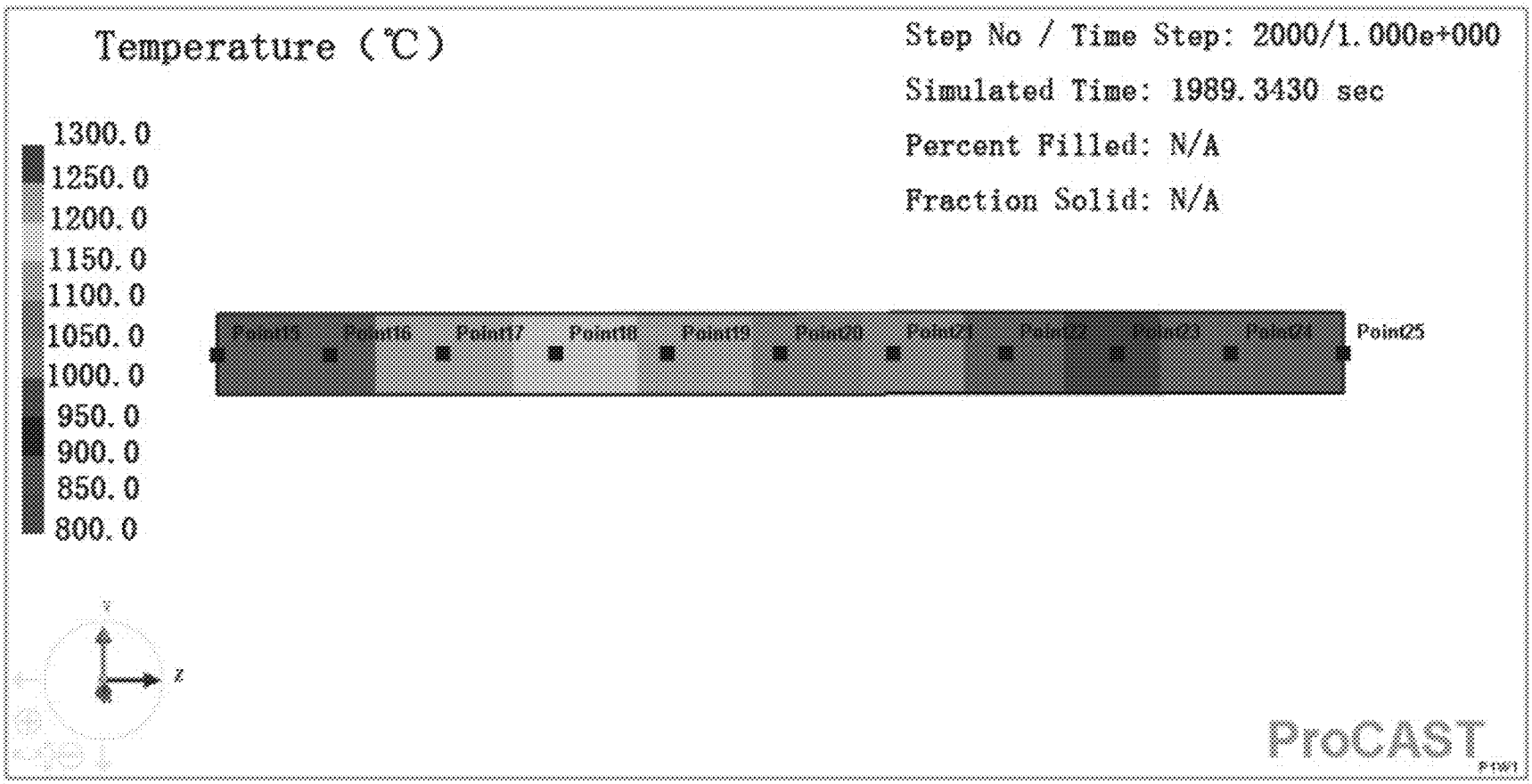
FIG. 4 illustrates the temperature distribution obtained by numerical simulation of heat transfer in the standard sample section by means of ProCast software.

FIG. 4 shows the temperature distribution obtained by numerical simulation of heat transfer in the standard sample section by means of ProCast software. It can be seen from FIG. 4 that due to the limitation of lateral heat transfer, the temperature field of the sample shows the characteristics of one-dimensional gradient distribution in the axial direction and straight distribution in the radial isotherm, indicating that the surface temperature of the sample is consistent with the center temperature thereof.

It can be seen from the above embodiment that the present disclosure provides a device and a method for continuous temperature gradient heat treatment of a rod-shaped material. The device of the present disclosure not only brings about improved experimental efficiency, but also a controlled temperature gradient of the rod-shaped material, and the surface temperature of the sample that is consistent with the internal temperature thereof.

The above is only the preferred embodiment of the disclosure. It should be pointed out that for those of ordinary skill in the art, varieties of improvements and refinements could be made without departing from the principle of the disclosure, and these improvements and refinements shall fall within the scope of the disclosure.

What is claimed is:

1. A method for continuous temperature gradient heat treatment of a rod-shaped material using a device, the device comprising a furnace body, a vacuum pumping equipment, an upper heating power supply and a lower heating power supply, wherein the vacuum pumping equipment, the upper heating power supply and the lower heating power supply are provided outside the furnace body, and wherein a sidewall of the furnace body is provided with an infrared thermal imaging temperature measuring window (5) and an air outlet (6), and the air outlet (6) is communicated with the vacuum pumping equipment, and the furnace body is provided with a water-cooling joint (1), an upper heating zone (2), a lower heating zone (3), and an annular radiation screen (4) inside, wherein the water-cooling joint (1) is fixed onto the top of the furnace body; the annular radiation screen (4) is located between the upper heating zone (2) and the lower heating zone (3), and a distance between the upper end of the annular radiation screen and the bottom of the upper heating zone is in the range of 0-2 mm, and a distance between the lower end of the annular radiation screen and the top of the lower heating zone is in the range of 0-2 mm: the annular radiation screen (4) is provided with a slit with a width of 1-2 mm along an axial direction, and the slit has a length same with that of the annular radiation screen (4), and the infrared thermal imaging temperature measuring window (5) is configured to match with the position of the slit;

the upper heating zone (2) is provided with an upper heating rod (71) and an upper closed heat insulation plate (81), and the lower heating zone (3) is provided with a lower heating rod (72) and a lower closed heat insulation plate (82), wherein the upper heating rod (71) in the upper heating zone (2) is connected to the upper heating power supply, the lower heating rod (72) in the lower heating zone (3) is connected to the lower heating power supply, and the upper closed heat insulation plate (81) and the lower closed heat insulation plate (82) respectively enclose the upper heating rod (71) and the lower heating rod (72) to form closed heating zones, and wherein an upper wall and a lower wall of the upper closed heat insulation plate (81), and an upper wall of the lower closed heat insulation plate (82) are respectively provided with a passage for the rod-shaped material to pass through; and an axis of the annular radiation screen (4) coincides with an axis of the rod-shaped material and a vertical centerline of the upper heating zone (2) and the lower heating zone (3); the annular radiation screen (4) is not in contact with the rod-shaped material;

the method comprising:

successively passing the rod-shaped material from bottom to top through the upper wall of the lower heating zone (3), the annular radiation screen (4) and the lower wall and the upper wall of the upper heating zone (2), fixing an upper end of the rod-shaped material onto the water-cooling joint (1), and taking a corresponding part of the rod-shaped material that is between the upper heating zone (2) and the lower heating zone (3) as a standard sample section;

vacuuming the furnace body by means of the vacuum pumping equipment, turning on the upper heating power supply and the lower heating power supply, heating a part of the rod-shaped material that is located in the upper heating zone (2) by means of the upper heating rod (71), and heating a part of the rod-shaped material that is located in the lower heating zone (3) by means of the lower heating rod (72), causing heat to be transferred along an axial direction of the rod-shaped material, to form a continuous temperature gradient in the standard sample section of the rod-shaped material, wherein set heating temperatures in the upper heating zone (2) and the lower heating zone (3) respectively correspond to endpoint temperatures of the temperature gradient of the standard sample section of the rod-shaped material; and measuring a continuous temperature gradient distribution situation of the standard sample section through the infrared thermal imaging temperature measuring window (5), and carrying out thermal insulation when the continuous temperature gradient distribution is stable.

2. The method for continuous temperature gradient heat treatment of a rod-shaped material of claim 1, further comprising turning on circulating water before heating under the condition that the device for continuous temperature gradient heat treatment of a rod-shaped material comprises a circulating water device.

3. The method for continuous temperature gradient heat treatment of a rod-shaped material of claim 2, wherein vacuuming the furnace body by means of the vacuum pumping equipment comprises vacuuming the furnace body to a pressure of not more than 3.3×10-2 Pa.

4. The method for continuous temperature: gradient heat treatment of a rod-shaped material of claim 2, further comprising before heating the rod-shaped material, providing a thermocouple on an outer wall of the standard sample section of the rod-shaped material, and correcting the continuous temperature gradient measured by the infrared thermal imaging by means of the thermocouple after obtaining a stable continuous temperature gradient.

5. The method for continuous temperature gradient heat treatment of a rod-shaped material of claim 1, wherein vacuuming the furnace body by means of the vacuum pumping equipment comprises vacuuming the furnace body to a pressure of not more than 3.3×10-2 Pa.

6. The method for continuous temperature gradient heat treatment of a rod-shaped material of claim 1, further comprising before heating the rod-shaped material, providing a thermocouple on an outer wall of the standard sample: section of the rod-shaped material, and correcting the continuous temperature gradient measured by the infrared thermal imaging by means of the thermocouple after obtaining a stable continuous temperature gradient.

* * * * *